US005468410A

United States Patent [19]

Angevaare et al.

[11] Patent Number: 5,468,410

[45] Date of Patent: Nov. 21, 1995

[54] PURINE CLASS COMPOUNDS IN DETERGENT COMPOSITIONS

[76] Inventors: Petrus A. Angevaare, 841 Bernard Pl., Ho-Ho-Kus, N.J. 07423; Richard G. Gary, 436 67th St., West New York, N.J. 07093

[21] Appl. No.: 302,284

[22] Filed: Sep. 8, 1994

Related U.S. Application Data

[63] Continuation-in-part of Ser. No. 136,629, Oct. 14, 1993, abandoned.

[51] Int. Cl.[6] ..... C11D 3/28; C11D 3/395; C11D 7/32; C11D 7/54

[52] U.S. Cl. ..... 252/95; 252/99; 252/102; 252/135; 252/156; 252/174.12; 252/390; 252/394; 252/524; 252/542; 134/25.2

[58] Field of Search ..... 252/95, 98, 99, 252/102, 135, 156, 174.12, 523, 390, 394, 524, 542; 134/25.2

[56] References Cited

U.S. PATENT DOCUMENTS

| | | | |
|---|---|---|---|
| 2,618,606 | 11/1952 | Schaeffer | 252/137 |
| 2,618,608 | 11/1952 | Schaeffer | 252/137 |
| 3,332,882 | 7/1967 | Blumbergs et al. | 252/186 |
| 3,956,158 | 5/1976 | Donaldson | 252/102 |
| 4,128,494 | 12/1978 | Schirmann et al. | 252/186 |
| 4,144,226 | 3/1979 | Crutchfield et al. | 528/231 |
| 4,146,495 | 3/1979 | Crutchfield et al. | 252/132 |
| 4,260,528 | 4/1981 | Fox et al. | 252/525 |
| 4,271,030 | 6/1981 | Brierley et al. | 252/98 |
| 4,279,769 | 7/1981 | Yagi et al. | 252/186 |
| 4,321,166 | 3/1982 | McGrady | 252/542 |
| 4,431,559 | 2/1984 | Ulrich | 252/99 |
| 4,511,487 | 4/1985 | Pruhs et al. | 252/99 |
| 4,620,936 | 11/1986 | Kielman et al. | 252/99 |
| 4,649,025 | 3/1987 | Hwa et al. | 422/15 |
| 4,740,327 | 4/1988 | Julemont et al. | 252/103 |
| 4,752,409 | 6/1988 | Drapier et al. | 252/94 |
| 4,836,948 | 6/1989 | Corring | 252/99 |
| 4,859,358 | 8/1989 | Gabriel et al. | 252/99 |
| 4,867,896 | 9/1989 | Elliott et al. | 252/94 |
| 4,933,101 | 6/1990 | Cilley et al. | 252/99 |
| 5,141,664 | 8/1992 | Corring | 252/90 |
| 5,200,236 | 4/1993 | Lang et al. | 252/95 |
| 5,230,822 | 7/1993 | Kamel et al. | 252/174.13 |
| 5,314,635 | 5/1994 | Hage et al. | 252/102 |

FOREIGN PATENT DOCUMENTS

| | | |
|---|---|---|
| 673033 | 1/1990 | Switzerland . |
| 836988 | 6/1960 | United Kingdom . |
| 855735 | 12/1960 | United Kingdom . |
| 907356 | 10/1962 | United Kingdom . |
| 907358 | 10/1962 | United Kingdom . |
| 907950 | 10/1962 | United Kingdom . |
| 1003310 | 9/1965 | United Kingdom . |
| 1246339 | 9/1971 | United Kingdom . |
| 2164350 | 3/1986 | United Kingdom . |
| 94/26860 | 11/1994 | WIPO . |

OTHER PUBLICATIONS

Singh et al., "Silver tarnishing and its prevention—A review," Anti–corrosion Methods Mater, 30 (Jul. 1983), pp. 4–8.

Cotton, J. B. et al., "Benzotriazole and Related Compounds as Corrosion Inhibitors for Copper," Brit. corros. J., Jan. 1967, vol. 2, pp. 1–4.

*Primary Examiner*—Paul Lieberman
*Assistant Examiner*—Lorna M. Douyon

[57] ABSTRACT

A detergent composition which prevents tarnishing of silver and silver-plated articles is described. The composition comprises 1–20 weight percent of a peroxygen or hypohalite bleaching agent, 0.05 to about 10 weight percent of a purine class compound used as a silver anti-tarnishing agent, from 1 to 75 weight percent of a builder, and 0 to 40 weight percent of a surfactant provided that the $pK_a$ of the purine class compound is below a pH of an aqueous solution of the composition in which it is incorporated. A method of using the composition is also described.

20 Claims, No Drawings

PURINE CLASS COMPOUNDS IN DETERGENT COMPOSITIONS

RELATED APPLICATIONS

This application is a continuation-in-part of U.S. Ser. No. 08/136,629, filed Oct. 14, 1993, now abandoned.

FIELD OF THE INVENTION

This invention relates to detergent compositions based on peroxygen and hypohalite bleaching agents having a purine class compound incorporated as a silver anti-tarnishing agent.

BACKGROUND OF THE INVENTION

Silver is chemically the most reactive element among the noble metals and tarnishes readily on exposure to sulfur bearing atmospheres. Because of its electronic state, silver exhibits a drastically different chemical behavior than, for instance, copper, although both metals are in the same group of the Periodic Table. Thus, silver tarnishing is quite different from corrosion of other metals.

Tarnishing, sometimes referred to as discoloration, is caused by a silver oxidation process in which sulfide is formed. Food such as onions, mustard and eggs which contain organic sulfur compounds are also known to tarnish silver. See Singh et al., "Silver Tarnishing and its Prevention—A Review" Anti-corrosion Methods and Materials, v. 30 (July 1983) pp. 4–8.

Silver tarnishing is also known to occur when a bleaching agent used in detergent compositions oxidizes the silver to silver oxide. This oxidation process causes surface blackening of the silver leaving undesirable tarnishing of silverware when machine dishwashed.

Use of organic compounds to enhance the resistance of a silver surface to tarnishing has been described in Singh et al., supra pp. 5–6. Certain triazoles, particularly benzotriazole and its variations are useful as silver inhibiting agents in detergent compositions as described in CH 673033 (1990) and U.S. Pat. No. 4,321,166 (Procter & Gamble-1982).

U.S. Pat. Nos. 2,618,606 (Procter & Gamble) and 2,618,608 (Procter & Gamble) disclose the use of azoles, including 1,2,3-triazole, imidazole, pyrazole and purine class compounds as discoloration inhibitors used in detergent compositions for nonferrous metals, such as copper and brass. The described detergents do not, however, contain a bleaching agent which complicates silver tarnish inhibition. The patents further state that a mixture of copper inhibitors are required to prevent tarnishing over a broad pH range.

Moreover, detergent compositions are increasingly being based on peroxygen bleaching agents and are being formulated to be milder to produce more environmentally friendly products. The problem of tarnishing of silver and silver plated articles has thus become more severe.

SUMMARY OF THE INVENTION

It is thus an object of the invention to provide a peroxygen or hypohalite bleach based detergent composition containing a purine class compound to prevent silver tarnishing. An aqueous solution of the compositions has a pH value in a range of about 7 to about 11.

Specifically, the purine class compounds must exhibit a $pK_a$ below, preferably more than one unit, more preferably more than 2 units below the pH value of the aqueous solution of the composition in which they are incorporated.

It is further an object of the invention to provide an environmentally friendly detergent composition which does not cause tarnishing of silver and silver plated articles.

Another object of the invention is to provide a method for washing silver and silver plated articles without discoloring them.

A further object is to protect such a silver article from tarnishing from organic food stuff with which it comes in contact.

Detergent compositions formulated for use in automatic dishwashing machines or fabric washing machines which are stable in a variety of physical forms, including liquid, powder, flakes, etc., is another object of the invention.

The inventive compositions comprise 1 to 20 weight percent of a peroxygen or hypohalite bleaching agent; 0 to 40 weight percent of a surfactant; 1 to 75 weight percent of a builder; and about 0.05 to about 10 weight percent of a purine class compound, provided the compositions exhibit a pH value in a range of about 7 to about 11 and provided that the $pK_a$ of the purine class compound is below, preferably at least one unit, more preferably at least two units, below a pH value of an aqueous solution of the composition.

DETAILED DESCRIPTION OF PREFERRED EMBODIMENTS

The detergent compositions of this invention comprise purine class compounds which provide a silver anti-tarnishing effect in a pH range of an aqueous solution of the composition of from about 7 to about 11, provided that the $pK_a$ value of the purine class compound is below, preferably more than one unit, more preferably at least 2 units and up to 6 units below the pH of an aqueous solution of the composition. Most preferably, the $pK_a$ is about 2 to about 6 units below the pH of an aqueous solution of the composition.

The term "$pK_a$" according to the invention means a pH value at which 50% of the five-membered rings of the purine class compounds are in anionic form.

The compounds of the invention are compounds having a formula:

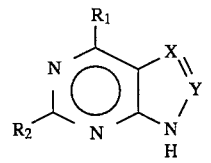

(I)

wherein X is nitrogen or C—$R_3$ and Y is nitrogen or C—$R_4$ and $R_1$, $R_2$, $R_3$ and $R_4$ are each independently a hydrogen, an oxygen, a hydroxy, an alkoxy, an amine, a straight or branched alkyl chain having 1 to 20 carbon atoms, an amido, an amidoalkyl, an alkylthio, an alkenyl or a hydroxyalkyl, provided that the $pK_a$ value of the purine class compound is more than 1 unit below the pH value of an aqueous solution of the composition in which it is incorporated. Preferably the $pK_a$ is more than 1 unit to 6 units below the pH of an aqueous solution of the composition, most preferably 2 to 6 units below the pH of an aqueous solution of the composition.

For purposes of this application, the phrase "a purine class compound" includes compounds of formula I as well as tautomeric forms of these compounds.

The term "alkyl" means a chain having 1 to 20 carbon atoms, preferably 1 to 6, most preferably 1 to 3.

Any of the substituted alkyls described above refers to a compound having an alkyl chain of 1 to 5 carbons, preferably 1 to 3.

Preferred compounds of formula 1 include those wherein X is nitrogen and Y is C— $R_4$ and $R_1$, $R_2$, $R_3$ and $R_4$ are independently hydrogen, hydroxy, alkoxy, an oxygen, alkylthio, amine, an amido and a lower alkyl having from 1 to 6 carbon atoms.

Especially preferred compounds include purine, adenine, guanine, 6-mercaptopurine, xanthine, hypoxanthine, uric acid, and allopurinol.

A commercially available source of the purine class compounds is Aldrich Chemical Co. of Milwaukee, Wiss.

When used in the inventive compositions, the purine class compound is present in an amount of from about 0.05 to about 10 weight percent, preferably 0.25 to about 2.5 weight percent, most preferably 0.75 to about 2 weight percent.

The pH of a 1% solution of the composition should be about 7 to about 13, preferably about 7 to about 11, most preferably 8 to about 10.

Peroxy Bleaching Agent

The oxygen bleaching agents of the compositions include organic peroxy acids and diacylperoxides. Typical monoperoxy acids useful herein include alkyl peroxy acids and aryl peroxy acids such as:

(i) peroxybenzoic acid and ring-substituted peroxybenzoic acids, e.g., peroxy-alpha-naphthoic acid, and magnesium monoperphthalate (ii) aliphatic and substituted aliphatic monoperoxy acids, e.g., peroxylauric acid, peroxystearic acid, epsilon-phthalimido peroxyhexanoic acid o-carboxybenzamido peroxyhexanoic acid, N-nonenylamidoperadipic acid and N-nonenylamidopersuccinic acid.

Typical diperoxy acids useful herein include alkyl diperoxy acids and aryldiperoxy acids, such as:

(iii) 1,12-diperoxydodecanedioic acid (iv) 1,9-diperoxyazelaic acid (v) diperoxybrassylic acid; diperoxysebacic acid and diperoxy-isophthalic acid (vi) 2-decyldiperoxybutane-1,4-dioic acid (vii) N,N-terephthaloyl-di(6-aminopercaproic acid).

A typical diacylperoxide useful herein includes dibenzoylperoxide.

Inorganic peroxygen compounds are also suitable for the present invention. Examples of these materials are salts of monopersulfate, perborate monohydrate, perborate tetrahydrate, and percarbonate.

Preferred oxygen bleaching agents include epsilon-phthalimido-peroxyhexanoic acid, o-carboxybenzamidoperoxyhexanoic acid, and mixtures thereof.

The oxygen bleaching agent is present in the composition in an amount from about 1 to 20 weight percent, preferably 1 to 15 weight percent, most preferably 2 to 10 weight percent.

The oxygen bleaching agent may be incorporated directly into the formulation or may be encapsulated by any number of encapsulation techniques known in the art to produce stable capsules in alkaline liquid formulations.

A preferred encapsulation method is described in U.S. Pat. No. 5,200,236 issued to Lang et al., herein incorporated by reference. In the patented method, the bleaching agent is encapsulated as a core in a paraffin wax material having a melting point from about 40° C. to about 50° C. The wax coating has a thickness of from 100 to 1500 microns.

Bleach Precursors

Suitable peroxygen peracid precursors for peroxy bleach compounds have been amply described in the literature, including GB Nos. 836,988; 855,735; 907,356; 907,358; 907,950; 1,003,310 and 1,246,339; U.S. Pat. Nos. 3,332,882 and 4,128,494.

Typical examples of precursors are polyacylated alkylene diamines, such as N,N,N',N'-tetraacetylethylene diamine (TAED) and N,N,N',N'-tetraacetyl-methylene diamine (TAMD); acylated glycolurils, such as tetraacetylglycoluril (TAGU); triacetylcyanurate, sodium sulphophyl ethyl carbonic acid ester, sodium acetyloxybenzene sulfonate (SABS), sodium nonanoyloxybenzene sulfonate (SNOBS) and choline sulfophenyl carbonate. Peroxybenzoic acid precursors are known in the art, e.g., as described in GB-A-836,988. Examples of suitable precursors are phenylbenzoate; phenyl p-nitrobenzoate; o-nitrophenyl benzoate; o-carboxyphenyl benzoate; p-bromo-phenylbenzoate; sodium or potassium benzoyloxy benzenesulfonate; and benzoic anhydride.

Preferred peroxygen bleach precursors are sodium p-benzoyloxy-benzene sulfonate, N,N,N',N'-tetraacetylethylene diamine, sodium nonanoyl-oxybenzene sulfonate and choline sulfophenyl carbonate.

Halogen Bleaches

Dry, particulate, water-soluble anhydrous inorganic salts are likewise suitable for use herein such as lithium, sodium or calcium hypohalite. Sodium hypochlorite is preferred for liquid formulations.

Detergent Builder Materials

The compositions of this invention can contain all manner of detergent builders commonly taught for use in automatic dishwashing or other cleaning compositions. The builders can include any of the conventional inorganic and organic water-soluble builder salts, or mixtures thereof and may comprise 1 to 75%, and preferably, from about 5 to about 70% by weight of the cleaning composition.

Typical examples of phosphorus-containing inorganic builders, when present, include the water-soluble salts, especially alkali metal pyrophosphates, orthophosphates and polyphosphates. Specific examples of inorganic phosphate builders include sodium and potassium tripolyphosphates, phosphates, pyrophosphates and hexametaphosphates.

Suitable examples of non-phosphorus-containing inorganic builders, when present, include water-soluble alkali metal carbonates, bicarbonates, sesquicarbonates, borates, silicates, metasilicates, and crystalline and amorphous aluminosilicates. Specific examples include sodium carbonate (with or without calcite seeds), potassium carbonate, sodium and potassium bicarbonates, silicates and zeolites.

Particularly preferred inorganic builders can be selected from the group consisting of sodium tripolyphosphate, potassium pyrophosphate, sodium carbonate, potassium carbonate, sodium bicarbonate, sodium silicate and mixtures thereof. When present in these compositions, sodium tripolyphosphate concentrations will range from about 2% to about 40%; preferably from about 5% to about 30%. Sodium carbonate and bicarbonate when present can range from about 5% to about 50%; preferably from about 10% to about 30% by weight of the cleaning compositions. Sodium tripolyphosphate and potassium pyrophosphate are preferred builders in gel formulations, where they may be used at from about 3 to about 30%, preferably from about 10 to about 20%.

Organic detergent builders can also be used in the present invention. Examples of organic builders include alkali metal citrates, succinates, malonates, fatty acid sulfonates, fatty acid carboxylates, nitrilotriacetates, phytates, phosphonates, alkanehydroxyphosphonates, oxydisuccinates, alkyl and alkenyl disuccinates, oxydiacetates, carboxymethyloxy succinates, ethylenediamine tetraacetates, tartrate monosuccinates, tartrate disuccinates, tartrate monoacetates, tartrate diacetates, oxidized starches, oxidized heteropolymeric polysaccharides, polyhydroxysulfonates, polycarboxylates such as polyacrylates, polymaleates, polyacetates, polyhydroxyacrylates, polyacrylate/polymaleate and polyacrylate/polymethacrylate copolymers, aminopolycarboxylates and polyacetal carboxylates such as those described in U.S. Pat. Nos. 4,144,226 and 4,146,495.

Alkali metal citrates, oxydisuccinates, polyphosphonates and acrylate/maleate copolymers are especially preferred organic builders. When present they are preferably available from about 1% to about 35% of the total weight of the detergent compositions.

The foregoing detergent builders are meant to illustrate but not limit the types of builders that can be employed in the present invention.

Surfactants

Useful surfactants include anionic, nonionic, cationic, amphoteric, zwitterionic types and mixtures of these surface active agents. Such surfactants are well known in the detergent art and are described at length in "Surface Active Agents and Detergents", Vol. II, by Schwartz, Perry & Birch, Interscience Publishers, Inc. 1959, herein incorporated by reference.

Anionic synthetic detergents can be broadly described as surface active compounds with one or more negatively charged functional groups. Soaps are included within this category. A soap is a $C_8$–$C_{22}$ alkyl fatty acid salt of an alkali metal, alkaline earth metal, ammonium, alkyl substituted ammonium or alkanolammonium salt. Sodium salts of tallow and coconut fatty acids and mixtures thereof are most common. Another important class of anionic compounds are the water-soluble salts, particularly the alkali metal salts, of organic sulfur reaction products having in their molecular structure an alkyl radical containing from about 8 to 22 carbon atoms and a radical selected from the group consisting of sulfonic and sulfuric acid ester radicals. Organic sulfur based anionic surfactants include the salts of $C_{10}$–$C_6$ alkylbenzene sulfonates, $C_{10}$–$C_{22}$ alkane sulfonates, $C_{10}$–$C_{22}$ alkyl ether sulfates, $C_{10}$–$C_{22}$ alkyl sulfates, $C_4$–$C_{10}$dialkylsulfosuccinates, $C_{10}$–$C_{22}$ acyl isethionates, alkyl diphenyloxide sulfonates, alkyl napthalene sulfonates, and 2-acetamido hexadecane sulfonates. Organic phosphate based anionic surfactants include organic phosphate esters such as complex mono- or diester phosphates of hydroxyl-terminated alkoxide condensates, or salts thereof. Included in the organic phosphate esters are phosphate ester derivatives of polyoxyalkylated alkylaryl phosphate esters, of ethoxylated linear alcohols and ethoxylates of phenol. Also included are nonionic alkoxylates having a sodium alkylenecarboxylate moiety linked to a terminal hydroxyl group of the nonionic through an ether bond. Counterions to the salts of all the foregoing may be those of alkali metal, alkaline earth metal, ammonium, alkanolammonium and alkylammonium types.

Nonionic surfactants can be broadly defined as surface active compounds with one or more uncharged hydrophilic substituents. A major class of nonionic surfactants are those compounds produced by the condensation of alkylene oxide groups with an organic hydrophobic material which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative, but not limiting examples, of various suitable nonionic surfactant types are:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from about 2 to about 50 ethylene oxide and/or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid, (b) polyoxyethylene or polyoxypropylene condensates of aliphatic alcohols, whether linear- or branched-chain and unsaturated or saturated, containing from about 6 to about 24 carbon atoms and incorporating from about 2 to about 50 ethylene oxide and/or propylene oxide units. Suitable alcohols include "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company.

Also included within this category are nonionic surfactants having a formula:

$$R-(\underset{\underset{R^1}{|}}{CH_2CHO})_x(CH_2CH_2O)_y(\underset{\underset{R^2}{|}}{CH_2CHO})_zH \qquad \text{(II)}$$

wherein R is a linear alkyl hydrocarbon radical having an average of 6 to 18 carbon atoms, $R^1$ and $R^2$ are each linear alkyl hydrocarbons of about 1 to about 4 carbon atoms, x is a integer of from 1 to 6, y is an integer of from 4 to 20 and z is an integer from 4 to 25.

One preferred nonionic surfactant of formula I is Poly-Tergent SLF-18® a registered trademark of the Olin Corporation, New Haven, Conn. having a composition of the above formula where R is a $C_6$–$C_{10}$ linear alkyl mixture, $R^1$ and $R^2$ are methyl, x averages 3, y averages 12 and z averages 16. Also suitable are alkylated nonionics as are described in U.S. Pat. No. 4,877,544 (Gabriel et al.), incorporated herein by reference.

Another nonionic surfactant included within this category are compounds of formula $$R^3-(CH_2CH_2O)_qH \qquad \text{(III)}$$

wherein $R^3$ is a $C_6$–$C_{24}$ linear or branched alkyl hydrocarbon radical and q is a number from 2 to 50; more preferably $R^3$ is a $C_8$–$C_{18}$ linear alkyl mixture and q is a number from 2 to 15.

(c) polyoxyethylene or polyoxypropylene condensates of alkyl phenols, whether linear- or branched-chain and unsaturated or saturated,containing from about 6 to 12 carbon atoms and incorporating from about 2 to about 25 moles of ethylene oxide and/or propylene oxide.

(d) polyoxyethylene derivatives of sorbitan mono-, di-, and tri-fatty acid esters wherein the fatty acid component has between 12 and 24 carbon atoms. The preferred polyoxyethylene derivatives are of sorbitan monolaurate, sorbitan trilaurate, sorbitan monopalmitate, sorbitan tripalmitate, sorbitan monostearate, sorbitan monoisostearate, sorbitan tripalmitate, sorbitan monostearate, sorbitan monoisostearate, sorbital tristearate, sorbitan monooleate, and sorbitan trioleate. The polyoxyethylene chains may contain between about 4 and 30 ethylene oxide units, preferably about 20. The sorbitan ester derivatives contain 1, 2 or 3 polyoxyethylene chains dependent upon whether they are mono-, di- or tri-acid esters.

(e) polyoxyethylene-polyoxypropylene block copolymers having formula:

$$HO(CH_2CH_2O)_a(CH(CH_3)CH_2O)_b(CH_2CH_2O)_cH \quad (IV)$$

or $$HO(CH(CH_3)CH_2))_d(CH_2CH_2O)_e(CHCH_3CH_2O)_fH \quad (V)$$

wherein a, b, c, d, e and f are integers from 1 to 350 reflecting the respective polyethylene oxide and polypropylene oxide blocks of said polymer. The polyoxyethylene component of the block polymer constitutes at least about 10% of the block polymer. The material preferably has a molecular weight of between about 1,000 and 15,000, more preferably from about 1,500 to about 6,000. These materials are well-known in the art. They are available under the trademark "Pluronic" and "Pluronic R" , a product of BASF Corporation.

(f) Alkyl glycosides having formula:

$$R^4O(R^5O)_n(Z^1)_p \quad (V)$$

wherein $R^4$ is a monovalent organic radical (e.g., a monovalent saturated aliphatic, unsaturated aliphatic or aromatic radical such as alkyl, hydroxyalkyl, alkenyl, hydroxyalkenyl, aryl, alkylaryl, hydroxyalkylaryl, arylalkyl, alkenylaryl, arylalkenyl, etc.) containing from about 6 to about 30 (preferably from about 8 to 18 and more preferably from about 9 to about 13) carbon atoms; $R^5$ is a divalent hydrocarbon radical containing from 2 to about 4 carbon atoms such as ethylene, propylene or butylene (most preferably the unit $(R^5O)_n$ represents repeating units of ethylene oxide, propylene oxide and/or random or block combinations thereof); n is a number having an average value of from to about 12; $Z^1$ represents a moiety derived from a reducing saccharide containing 5 or 6 carbon atoms (most preferably a glucose unit); and p is a number having an average value of from 0.5 to about 10 preferably from about 0.5 to about 5.

Within the compositions of the present claim, alkyl polyglycosides will be present in amounts ranging from about 0.01 to about 20% by weight, preferably from about 0.5 to about 10%, optimally between about 1 and 5%.

Examples of commercially available materials from Henkel Kommanditgesellschaft Aktien of Dusseldorf, Germany include APG® 300, 325 and 350 with $R^4$ being $C_9$–$C_{11}$, n is 0 and p is 1.3, 1.6 and 1.8–2.2 respectively; APG® 500 and 550 with $R^4$ is $C_{12}$–$C_{13}$, n is 0 and p is 1.3 and 1.8–2.2, respectively; and APG® 600 with $R^4$ being $C_{12}$–$C_{14}$, n is 0 and p is 1.3. Particularly preferred is APG® 600.

(g) Amine oxides having formula:

$$R^5R^6R^7N{=}O \quad (VII)$$

wherein $R^5$, $R^6$ and $R^7$ are saturated aliphatic radicals or substituted saturated aliphatic radicals. Preferable amine oxides are those wherein $R^5$ is an alkyl chain of about 10 to about 20 carbon atoms and $R^6$ and $R^7$ are methyl or ethyl groups or both $R^5$ and $R^6$ are alkyl chains of about 6 to about 14 carbon atoms and $R^7$ is a methyl or ethyl group.

Amphoteric synthetic detergents can be broadly described as derivatives of aliphatic and tertiary amines, in which the aliphatic radical may be straight chain or branched and wherein one of the aliphatic substituents contain from about 8 to about 18 carbons and one contains an anionic water-solubilizing group, i.e., carboxy, sulpho, sulphato, phosphato or phosphono. Examples of compounds falling within this definition are sodium 3-dodecylamino propionate and sodium 2-dodecylamino propane sulfonate.

Zwitterionic synthetic detergents can be broadly described as derivatives of aliphatic quaternary ammonium, phosphonium and sulphonium compounds in which the aliphatic radical may be straight chained or branched, and wherein one of the aliphatic substituents contains from about 8 to about 18 carbon atoms and one contains an anionic water-solubilizing group, e.g., carboxy, sulpho, sulphato, phosphato or phosphono. These compounds are frequently referred to as betaines. Besides alkyl betaines, alkyl amino and alkyl amido betaines are encompassed within this invention.

Silicates

The compositions of this invention may contain sodium or potassium silicate at a level of from about 1 to about 40%, preferably 1–20% by weight of the cleaning composition. This material is employed as a cleaning ingredient, source of alkalinity, metal corrosion inhibitor and protector of glaze on china tableware. Especially effective is sodium silicate having a ratio of $SiO_2$:Na2O of from about 1.0 to about 3.3, preferably from about 2 to about 3.2. Some of the silicate may be in solid form.

Filler

An inert particulate filler material which is water-soluble may also be present in cleaning compositions in powder form. This material should not precipitate calcium or magnesium ions at the filler use level. Suitable for this purpose are organic or inorganic compounds. Organic fillers include sucrose esters and urea. Representative inorganic fillers include sodium sulfate, sodium chloride and potassium chloride. A preferred filler is sodium sulfate. Its concentration may range from 0% to 60%, preferably from about 10% to about 30% by weight of the cleaning composition.

Thickeners and Stabilizers

Thickeners are often desirable for liquid cleaning compositions. Thixotropic thickeners such as smectite clays including montmorillonite (bentonite), hectorite, saponite, and the like may be used to impart viscosity to liquid cleaning compositions. Silica, silica gel, and aluminosilicate may also be used as thickeners. Salts of polyacrylic acid (of molecular weight of from about 300,000 up to 6 million and higher), including polymers which are cross-linked may also be used alone or in combination with other thickeners. Use of clay thickeners for automatic dishwashing compositions is disclosed for example in U.S. Pat. Nos. 4,431,559; 4,511,487; 4,740,327; 4,752,409. Commercially available synthetic smectite clays include Laponite supplied by Laporte Industries. Commercially available bentonite clays include Korthix H and VWH ex Combustion Engineering, Inc.; Polargel T ex American Colloid Co.; and Gelwhite clays (particularly Gelwhite GP and H) ex English China Clay Co. Polargel T is preferred as imparting a more intense white appearance to the composition than other clays. The amount of clay thickener employed in the compositions is from 0.1 to about 10%, preferably 0.5 to 5%. Use of salts of polymeric carboxylic acids is disclosed for example in UK Patent Application GB 2,164,350A, U.S. Pat. No. 4,859,358 and 4,836,948.

For liquid formulations with a "gel" appearance and rheology, particularly if a clear gel is desired, a chlorine stable polymeric thickener is particularly useful. U.S. Pat. No. 4,260,528 discloses natural gums and resins for use in clear autodish detergents, which are not chlorine stable. Acrylic acid polymers that are cross-linked manufactured by, for example, B. F. Goodrich and sold under the trade name "Carbopol" have been found to be effective for production of clear gels, and Carbopol 940 and 617, having a molecular weight of about 4,000,000 is particularly preferred for maintaining high viscosity with excellent chlorine stability over extended periods. Further suitable chlorine-stable polymeric thickeners are described in U.S. Pat. No. 4,867,896 incorporated by reference herein.

The amount of thickener employed in the compositions is from 0 to 5%, preferably 0.5–3%.

Stabilizers and/or co-structurants such as long chain calcium and sodium soaps and $C_2$ to $C_8$ sulfates are detailed in U.S. Pat. Nos. 3,956,158 and 4,271,030 and the use of other metal salts of long chain soaps is detailed in U.S. Pat. No. 4,752,409. Other co-structurants include Laponite and metal oxides and their salts as described in U.S. Pat. No. 4,933,101, herein incorporated by reference. The amount of stabilizer which may be used in the liquid cleaning compositions is from about 0.01 to about 5% by weight of the composition, preferably 0.01–2%. Such stabilizers are optional in gel formulations. Co-structurants which are found especially suitable for gels include trivalent metal ions at 0.01–4% of the compositions, Laponite and/or water-soluble structuring chelants at 1–60%. These co-structurants are more fully described in the co-pending U.S. patent application Ser. No. 139,492, by Corring et al., filed Dec. 30, 1987, which application is hereby incorporated by reference.

Defoamer

The formulations of the cleaning composition comprising surfactant may further include a defoamer. Suitable defoamers include mono- and distearyl acid phosphate, silicone oil and mineral oil. Even if the cleaning composition has only defoaming surfactant, the defoamer assists to minimize foam which food soils can generate. The compositions may include 0.02 to 2% by weight of defoamer, or preferably 0.05–1.0%.

Minor amounts of various other components may be present in the cleaning composition. These include bleach scavengers including but not limited to sodium bisulfite, sodium perborate, reducing sugars, and short chain alcohols; solvents and hydrotropes such as ethanol, isopropanol and xylene sulfonates; flow control agents (in granular forms); enzyme stabilizing agents; soil suspending agents; antiredeposition agents; anti-tarnish agents; anti-corrosion agents; colorants; other functional additives; and perfume. The pH of the cleaning composition may be adjusted by addition of strong acid or base. Such alkalinity or buffering agents include sodium carbonate and sodium borate.

Enzymes

Enzymes capable of faciliating the removal of soils from a substrate may also present in the invention in an amount of from 0 to 10 weight percent, preferably 1 to about 5 weight percent. Such enzymes include proteases (e.g., Alcalase®, Savinase® and Esperase® from Novo Industries A/S), amylases (e.g., Termamyl® from Novo Industries A/S), lipases (e.g., Lipolase® from Novo Industries A/S), oxidases or mixtures thereof.

The following examples will more fully illustrate the embodiments of the invention. All parts, percentages and proportions referred to herein and in the appended claims are by weight unless otherwise indicated.

EXAMPLE 1

The following seven (7) machine dishwashing compositions were prepared as follows:

| Ingredient | % by weight |
|---|---|
| Sodium Citrate ($2H_2O$) | 30.0 |
| Sodium Tetraborate | 3.0 |
| Glycerol | 6.0 |
| Sokalan CP7 (40%)[1] | 5.0 |
| Sodium Hydroxide (50%) | 1.6 |
| Bleaching Agent[2] | x |
| Anti-tarnish Agent[3] | y |
| Water | to 100 |

[1]an acrylic acid/maleic acid copolymer supplied by BASF Corporation of Parsippany, New Jersey.

[2]The following different levels of sodium perborate ($H_2O$) and TAED (N,N,N',N'-tetraacetylethylene diamine bleach activator) were used in example 1:

a. 0.0% sodium perborate ($H_2O$) and 0.0% TAED
b. 0.5% sodium perborate ($H_2O$) and 0.3% TAED
c. 0.7% sodium perborate ($H_2O$) and 0.5% TAED
d. 0.9% sodium perborate ($H_2O$) and 0.6% TAED
e. 1.3% sodium perborate ($H_2O$) and 0.9% TAED
f. 1.7% sodium perborate ($H_2O$) and 1.1% TAED
g. 6.8% sodium perborate ($H_2O$) and 4.3% TAED

[3]No anti-tarnish agent was used in example 1.

Tarnish monitoring experiments to determine silver tarnishing were conducted with compositions a, b, c, d, e, f, and g at a product dosage of 40 grams per run in a European dishwasher, Bauknecht GSF 3162, with an intake of 5 liters deionized water. The wash program consisted of a pre-wash at 40° C., a mainwash at 55° C., two intermediate rinses, and a final rinse at 65° C. The mainwash pH with these compositions was typically about 8.7. Silver-plated spoons (2 per run) were the monitors used in the test. The spoons were supplied by Oneida Silversmiths, USA. The monitors were washed in a commercially available hand dishwash liquid and rinsed with deionized water and acetone before use. In the dishwasher the monitors were kept apart from each other in the cutlery basket. At the end of a single-run machine program, the monitors were visually analyzed for the presence of colors and the loss of gloss.

The spoons washed with composition a were unchanged after the dishwashing process, except for a few stain spots. The stain spots were caused by deposition of non-volatile materials during the evaporation of undrained wash solution in the drying step of the machine program and are not related to a tarnishing (i.e., silver oxidation) process of the monitors.

However, the spoons washed with compositions b, c, d, e, f, and g were increasingly tarnished as the levels of bleaching agent were increased. The spoons washed with composition g were so heavily tarnished that they lost their gloss and were turned brown/black. The set of spoons washed with the compositions a, b, c, d, e, f, and g were ranked from zero to six, respectively. This ranking of spoons was used as a reference scale for all subsequent examples.

EXAMPLE 2

Machine dishwashing compositions were prepared as described in Example 1 except the selected bleaching agent was epsilon-phthalimido peroxyhexanoic acid incorporated at 4 weight percent. The compound was supplied by Hoechst AG of Germany. The compositions also contained various anti-tarnish agents incorporated in an amount of 1 weight percent as follows:

| SAMPLE | ANTI-TARNISHING AGENT (1 WT. %) |
|---|---|
| A | None |
| B | Purine |
| C | Adenine |
| D | Guanine |
| E | 6-mercaptopurine |
| F | Xanthine |
| G | Uric acid |
| H | Allopurinol |

The anti-tarnishing agents were supplied by Aldrich Chemical Co. of Milwaukee, Wis.

Tarnish monitoring experiments as described in Example 1 were conducted with Samples A–H using two silver-plated spoons as monitors in each of the experiments. The main wash pH in this series of experiments was between 8.8 and 8.5.

Anti-tarnish scores ranging from 0 to 6 according to the level of tarnishing were obtained for samples A–H as follows:

TABLE 1

| Composition | Tarnish Score |
|---|---|
| A | 5 |
| B | 0 |
| C | 0.5 |
| D | 0 |
| E | 1 |
| F | 0 |
| G | 1 |
| H | 0 |

It was observed that spoons washed with compositions containing anti-tarnish agents (Samples B–H) either remained unchanged or developed a slightly yellowish appearance during the dishwashing process. In contrast, the control sample A, which did not contain an anti-tarnish agent, produced heavy tarnishing.

EXAMPLE 3

A detergent base was prepared having the following formula:

| Ingredient | % by weight |
|---|---|
| Sodium Citrate ($2H_2O$) | 42 |
| Sodium Disilicate 2.0 | 35 |
| Sodium Perborate ($H_2O$) | 7 |
| Sokalan CP5[1] | 5 |
| TAED[2] (80%) | 4.2 |
| Amylase | 1.7 |
| Protease | 1.7 |
| Laponite[3] | 1.7 |
| Non-ionic Surfactant | 1.7 |

[1]An acrylic acid/maleic acid copolymer supplied by BASF, Germany.
[2]N,N,N',N'-tetraacetylethylene diamine.
[3]A smectite clay supplied by Laporte Industries of Chesire, England.

Various amounts of an adenine compound were dosed into 27 gram samples of the foregoing base as follows:

| SAMPLES | ADENINE (% by weight) |
|---|---|
| 1 | 0 |
| 2 | 0.05 |
| 3 | 0.1 |
| 4 | 0.25 |
| 5 | 0.5 |

As described in Example 1, tarnish monitoring tests were conducted with samples 1–5 using two silver-plated spoons as monitors. However, 1 gram/liter of sodium chloride was added to the deionized water used in the experiments. Additionally, 5 grams of egg yolk were dosed in the dishwasher immediately after water intake at the start of the main wash of each experiment. The main wash pH values were typically about 9.8.

Silver tarnishing scores on a scale of 0 to 6 were observed for samples 1–5 as follows:

TABLE 3

| Sample | Tarnish Score |
|---|---|
| 1 | 3 |
| 2 | 1.5 |
| 3 | 1.5 |
| 4 | 0 |
| 5 | 1 |

The control sample containing no anti-tarnishing agent gave rise to moderately heavy tarnishing. In contrast, samples 2 through 5 exhibited little to no tarnishing. Optimal anti-tarnishing performance was observed with sample 4 containing 0.25 wt. % adenine.

EXAMPLE 4

Six (6) machine dishwashing compositions were prepared as described in Example 1 except the type of bleaching agent and the amount of purine as the anti-tarnish agent were varied as follows:

| Samples | Bleaching Agent (% by Wt) | Purine (% by wt) |
|---|---|---|
| A | Peracetic acid[1]-4.12% | — |
| B | Peracetic acid[1]-4.12% | 1.0% |

-continued

| Samples | Bleaching Agent (% by Wt) | Purine (% by wt) |
|---|---|---|
| C | Epsilon-phtalimidoperoxyhexanoic acid[2]-4.0% | — |
| D | Epsilon-phtalimidoperoxyhexanoic acid[2]-4.0% | 1.0% |
| E | Sodium hypochlorite[3]-8.23% | — |
| F | Sodium hypochlorite[3]-8.23% | 1.0% |

[1]A 32% peracetic acid solution, supplied by Aldrich Corporation of Milwaukee, was used.
[2]Supplied by Hoechst AG, Germany.
[3]A 8.2% active $Cl_2$ solution was used, supplied by Jones Chemicals of Caledonia, NY.

Tarnishing monitoring experiments were conducted using samples A, B, C, D, E, and F at a product dosage of 40 grams per run in a Bauknecht GSF 3162 dishwasher, with an intake of 5 liters water. The mainwash pH values for compositions A and B were adjusted to 7.5; the mainwash pH values for compositions C and D were adjusted to 8.5. Two experiments (each) were conducted using compositions E and F; the mainwash pH values were adjusted to 9.0 and 10.5, respectively. Silver plated spoons, knives, and forks (supplied by Oneida Silversmiths, USA), were used as monitors for all experiments. The monitors were washed in a commercially available hand dishwashing liquid and rinsed with deionized water and acetone before use. At the end of the dishwashing machine program, the monitors were visually evaluated for the presence of colors and/or loss of shine, according to the reference scale described in Example 1.

Each sample containing purine (B, D and F) were observed to reduce the level of tarnishing relative to the samples which did not contain purine (A, C and E). While tarnishing inhibition due to purine occurs through the pH range described above, this effect was observed to be greatest at pH values of 7.5, 8.5 and 9.0. Furthermore, the presence of purine reduced tarnishing regardless of the type of bleaching agent (chlorine or oxygen) present in the samples.

EXAMPLE 5

The required association of the $pK_a$ of the purine class compound and the pH of the composition in which it is incorporated to provide effective silver anti-tarnishing was demonstrated and the results are reported below.

The $pK_a$ of each compound was determined by preparing a 0.001M solution of inhibitor in deionized water. The pH of this solution was adjusted to 3.0 with $H_2SO_4$. The solution was then titrated with 1N NaOH to pH 11.0. A plot of mls. NaOH vs. pH for each sample was prepared. The $pK_a$ of the compound is that point where the maximum change in pH as a function of mls. NaOH is observed.

A comparison of anti-tarnishing performance of purine class compounds within the scope of the invention and azole compounds outside was conducted. The selected compounds were incorporated in an amount of 1 wt. % in a machine dishwashing composition containing 4% wt epsilon-phthalimido peroxyhexanoic acid as the bleaching agent. The pH values of the compositions were adjusted by the addition of a 50% solution of sodium hydroxide or concentrated sulfuric acid, as necessary.

Silver plates were then held in each of the compositions for 25 minutes, removed, rinsed with deionized water and evaluated for silver tarnishing, and ranked as described in Example 1. A tarnish score of 3 or less was considered effective as a silver anti-tarnishing compound. The observations were tabulated as presented below:

| Compounds | | $pK_a$ of compounds | pH of Aqueous Solution of Composition | Effective Silver Anti-Tarnishing |
|---|---|---|---|---|
| 1) Purine | 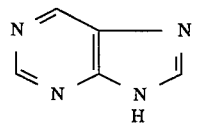 | 5.5 | 8.6 | Yes |
| 2) Adenine | 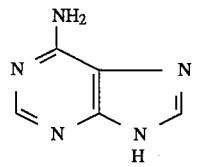 | 7.2 | 8.6 | Yes |
| 3) Adenine | | 7.2 | 6.9 | No |
| 4) Guanine | 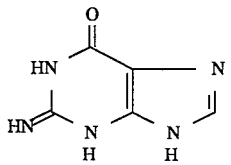 | 6.7 | 7.0 | No |
| 5) Guanine | | 6.7 | 8.6 | Yes |

-continued

| Compounds | | $pK_a$ of compounds | pH of Aqueous Solution of Composition | Effective Silver Anti-Tarnishing |
|---|---|---|---|---|
| 6) Xanthine | 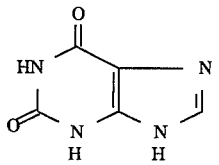 | 7.0 | 8.6 | Yes |
| 7) Hypoxanthine | 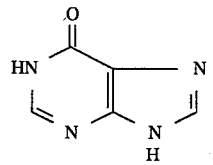 | 6.0 | 8.6 | Yes |
| 8) Uric Acid | 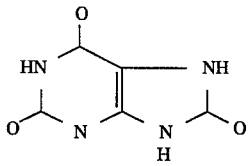 | 4.6 | 8.6 | Yes |
| 9) Allopurinol | 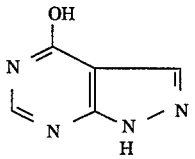 | 6.1 | 8.6 | Yes |

It was observed that the claimed compounds must exhibit a $pK_a$ of more than 1 unit less than the pH of an aqueous solution of the composition in which they are incorporated. In particular, adenine ($pK_a$=7.2) and guanine ($pK_a$=6.7) prevented silver tarnishing at pH 8.6, but did not prevent tarnishing at pH 6.9 and 7.0, respectively.

Azole compounds outside the scope of the invention were tested and the following silver anti-tarnishing results were observed.

| Compound | | $pK_a$ of compounds | pH of composition | Effective Silver Anti-Tarnishing |
|---|---|---|---|---|
| 1) 6-Nitroindazole | 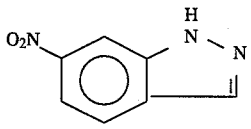 | 6.8 | 8.5 | No |
| 2) 6-Nitroindazole | | 6.8 | 11.0 | No |
| 3) 2-Phenylimidazole | 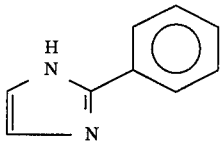 | 8.8 | 8.5 | No |
| 4) 2-Phenylimidazole | | 8.8 | 11.0 | No |
| 5) Arginine | 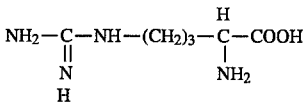 | 9.1 | 8.6 | No |

-continued

| Compound | | $pK_a$ of compounds | pH of composition | Effective Silver Anti-Tarnishing |
|---|---|---|---|---|
| 6) Pyrrole | 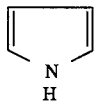 | 11.0 | 8.6 | No |
| 7) Pyrazole | 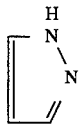 | 11.5 | 8.6 | No |

It was observed that compounds having $pK_a$ values greater than the pH values of the compositions in which they were incorporated did not exhibit anti-tarnishing effects.

EXAMPLE 6

To demonstrate the ineffectiveness of known copper anti-tarnishing compounds on silver plates, machine dishwashing compositions having a pH of both 8.5 and 11 were prepared containing 4% by weight epsilon-phthalimido peroxyhexanoic acid as the bleaching agent and 1% by weight of three (3) copper antitarnishing compounds listed below. Samples of the compositions were adjusted to both a pH of 8.5 and 11 by the addition of sodium hydroxide. Copper plates and silver plates were held in each of the compositions for 25 minutes, removed, rinsed with deionized water and evaluated for tarnishing. The following results were observed.

| Copper Antitarnishing Compounds[1] | Copper Plates | Silver Plates |
|---|---|---|
| 6-nitroindazole | + | – |
| 2-phenylimidazole | + | – |
| pyrazole | + | – |

[1]Described as effective copper anti-tarnish compounds in Schaeffer, U.S. Pat. No. 2,618,608

It was observed that antitarnishing compounds which prevented tarnishing on copper plates had no effect in preventing silver tarnishing. The oxidation behavior of copper versus silver is quite different and compounds which affect one type of metal may be drastically different from those compounds which affect the other. The compounds exhibiting copper antitarnishing effects do not possess a purine class structure within the scope of the claimed invention.

We claim:

1. An automatic dishwashing detergent composition comprising:

a) 1 to 20 weight percent of a bleaching agent selected from the group of a peroxygen agent, a hypohalite agent and its corresponding salts, and mixtures thereof;

b) 0.05 to about 10 weight percent of a purine class compound which prevents silver tarnishing and having a formula:

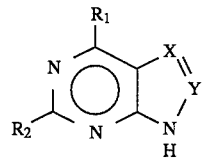

(I)

wherein X is nitrogen or C—$R_3$, Y is nitrogen or C—$R_4$, and $R_1$, $R_2$, $R_3$ and $R_4$ are independently a hydrogen, an oxygen, a hydroxy, an alkoxy, an amine, a straight or branched alkyl chain having 1 to 20 carbon atoms, an amido, an amidoalkyl, an alkylthio, an alkenyl or a hydroxyalkyl, provided that a $pK_a$ value of the purine class compound is more than 1 unit below a pH value of an aqueous solution of a detergent composition in which it is incorporated;

c) 1 to 75 weight percent of a builder; and d) 0 to 40 weight percent of a surfactant wherein the detergent composition has a pH in a range of about 7 to about 11 and substantially prevents tarnishing of silver and silver plated articles in an automatic dishwasher.

2. A detergent composition according to claim 1 wherein the purine class compound of formula I includes those compounds wherein X is nitrogen, Y is C—$R_4$, and $R_1$, $R_2$, $R_3$ and $R_4$ are each independently a hydrogen, an oxygen, a hydroxy, an alkoxy, an amine, or a lower alkyl having $C_1$ to $C_6$ carbon atoms.

3. A detergent composition according to the claim 2 wherein the purine class compound of formula I is selected from the group consisting of purine, adenine, guanine, 6-mercaptopurine, xanthine, hypoxanthine, uric acid, and allopurinol.

4. A detergent composition according to claim 1 wherein the peroxygen agent is an organic agent or an inorganic agent.

5. A detergent composition according to claim 4 wherein the organic agent is selected from the group consisting of epsilon-phthalimido peroxyhexanoic acid, o-carboxybenzamido peroxyhexanoic acid and N,N-terephthaloyl-di(6-aminopercaproic acid).

6. A detergent composition according to claim 4 wherein the inorganic agent is selected from a group consisting of salts or perborate monohydrate, monopersulfate, perborate tetrahydrate, percarbonate and mixtures thereof.

7. A detergent composition according to claim 1 further comprising an effective amount of peroxygen peracid precursor.

8. A detergent composition according to claim 7 wherein the peroxygen peracid precursor is selected from a group consisting of sodium p-benzoyloxybenzene sulfonate, N,N,N',N'-tetraacetyl ethylenediamine, sodium nonanoyloxybenzene sulfonate and choline sulfophenyl carbonate.

9. A detergent composition according to claim 1 wherein the hypohalite agent is sodium hypochlorite.

10. A detergent composition according to claim 1 wherein the builder is selected from the group consisting of alkali metal citrates, succinates, tartrate disuccinates, polycarboxylates, aluminosilicates and mixtures thereof.

11. A detergent composition according to claim 1 wherein the anti-tarnishing compound is present in an amount of from about 0.25 to about 2.5 weight percent.

12. A detergent composition according to claim 1 further comprising about 0.1 to 40 weight percent of an alkalinity agent.

13. A detergent composition according to claim 1 further comprising an enzyme in an amount of up to about 10 wt. %.

14. A method for substantially preventing tarnishing of silver or silver plated articles comprising the steps of:

washing the silver or silver plated articles in an effective amount of an automatic dishwashing detergent composition having the composition:

a) 1 to 20 weight percent of a bleaching agent selected from the group of a peroxygen agent, a hypohalite agent and its corresponding salts, and mixtures thereof;

b) 0.05 to about 10 weight percent of a purine class compound which prevents silver tarnishing and having a formula:

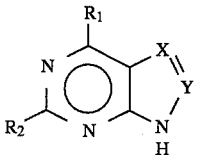

(I)

wherein X is nitrogen or C—$R_3$, Y is nitrogen or C—$R_4$, and $R_1$, $R_2$, $R_3$ and $R_4$ are independently a hydrogen, an oxygen, a hydroxy, an alkoxy, an amine, a straight or branched alkyl chain having 1 to 20 carbon atoms, an amido, an amidoalkyl, an alkylthio, an alkenyl or a hydroxyalkyl, provided that a $pK_a$ value of the purine class compound is more than 1 unit below a pH of an aqueous solution of a detergent composition in which it is incorporated;

c) 1 to 75 weight percent of a builder; and d) 0 to 40 weight percent of a surfactant, the composition having a pH in a range of about 7 to about 11, to substantially prevent tarnishing of the silver or silver-plated articles during the washing process.

15. A method according to claim 14 wherein the peroxygen agent is an organic agent or an inorganic agent.

16. A method according to claim 15 wherein the organic agent is selected from the group consisting of epsilon-phthalimidoperoxy hexanoic acid, o-carboxybenzamido peroxyhexanoic acid, and N,N-terephthaloyl-di(6-amino-percaproic acid) and mixtures thereof.

17. A method according to claim 15 wherein the inorganic agent is selected from a group consisting of salts or perborate monohydrate, monopersulfate, perborate tetrahydrate, percarbonate and mixtures thereof.

18. A method according to claim 14 wherein the composition further comprises an effective amount of peroxygen peracid precursor.

19. A method according to claim 14 wherein the hypohalite agent is sodium hypochlorite.

20. A method according to claim 14 wherein the purine class compound of formula I is selected from the group consisting of purine, adenine, guanine, 6-mercaptopurine, xanthine, hypoxanthine, uric acid and allopurine.

* * * * *

UNITED STATES PATENT AND TRADEMARK OFFICE

CERTIFICATE OF CORRECTION

PATENT NO. : 5,468,410

DATED : November 21, 1995

INVENTOR(S) : Angevaare et al.

It is certified that error appears in the above-indentified patent and that said Letters Patent is hereby corrected as shown below:

On the title page, insert item [73], to read as follows:

—Lever Brothers Company, Division of Conopco, Inc.—

Signed and Sealed this

Twenty-fifth Day of June, 1996

*Attest:*

Bruce Lehman

BRUCE LEHMAN

*Attesting Officer*

*Commissioner of Patents and Trademarks*